US009254581B2

(12) United States Patent
Ohlendorf et al.

(10) Patent No.: US 9,254,581 B2
(45) Date of Patent: Feb. 9, 2016

(54) DEVICE AND METHOD FOR GLUING FIBERS

(75) Inventors: Rudolf Christopher Ohlendorf, Toenisvorst (DE); Guenter Staub, Krefeld (DE); Rolf Trummel, Duesseldorf (DE)

(73) Assignee: SIEMPELKAMP MASCHINEN-UND ANLAGENBAU GmbH, Krefeld (DE)

( * ) Notice: Subject to any disclaimer, the term of this patent is extended or adjusted under 35 U.S.C. 154(b) by 35 days.

(21) Appl. No.: 14/114,601

(22) PCT Filed: May 25, 2012

(86) PCT No.: PCT/EP2012/059833
§ 371 (c)(1),
(2), (4) Date: Dec. 19, 2013

(87) PCT Pub. No.: WO2012/163828
PCT Pub. Date: Dec. 6, 2012

(65) Prior Publication Data

US 2014/0106069 A1 Apr. 17, 2014

(30) Foreign Application Priority Data

May 27, 2011 (DE) ..... 10 2011 103 326

(51) Int. Cl.
*B05B 17/00* (2006.01)
*B05B 7/06* (2006.01)
(Continued)

(52) U.S. Cl.
CPC . *B27K 5/00* (2013.01); *B27N 1/029* (2013.01); *B27N 1/0254* (2013.01); *B27N 1/0263* (2013.01)

(58) Field of Classification Search
USPC ..... 118/325, 313–315, 303, 684; 156/62.2, 156/62.4, 296, 578, 356; 264/109–126, 264/128; 425/80.1
See application file for complete search history.

(56) References Cited

U.S. PATENT DOCUMENTS 5,683,752 A 11/1997 Popp
6,059,884 A 5/2000 Seitz
(Continued)

FOREIGN PATENT DOCUMENTS

DE 10031852 A 1/2002
DE 102008059877 A 6/2010
(Continued)

OTHER PUBLICATIONS

Device for applying binding agent on lignocellulose, DE 202008015419 U1, May 27, 2010.*

*Primary Examiner* — Yewebdar Tadesse
(74) *Attorney, Agent, or Firm* — Andrew Wilford

(57) ABSTRACT

A device for gluing fibers or similar particles, in particular for the production of wood material panels, for example fiber panels, having a blowline (3) through which the fibers to be glued are transported, wherein there are connected to the blowline a plurality of nozzles (4) which issue into the blowline and by means of which the fibers transported through the blowline can be sprayed with glue, wherein the nozzles (4) are formed as multiple-substance nozzles, for example two-substance nozzles for the purpose of steam atomization, to which nozzles in each case at least one glue feed line (5) and one steam feed line (6) are connected, characterized in that in each case one glue valve (7) and one throughflow measurement device (8) are integrated into the glue feed lines (5), and in that the glue valves (7) and the throughflow measurement devices (8) are connected to at least one control and/or regulating device, such that the throughflow rate for each glue feed line (5) can be separately controlled or regulated by means of the glue valves (7).

11 Claims, 5 Drawing Sheets

(51) Int. Cl.
*B27K 5/00* (2006.01)
*B27N 1/02* (2006.01)

(56) References Cited

U.S. PATENT DOCUMENTS 6,296,706 B1 10/2001 Dattilo
2005/0103446 A1* 5/2005 Foucht et al. ..... 156/351
2008/0271850 A1* 11/2008 Stutz ..... 156/356
2010/0209592 A1 8/2010 Wanthal

FOREIGN PATENT DOCUMENTS

DE 102009006704 A 8/2010
DE 202010005280 A 9/2010

* cited by examiner

DEVICE AND METHOD FOR GLUING FIBERS

CROSS REFERENCE TO RELATED APPLICATIONS

This application is the US-national stage of PCT application PCT/EP2012/059833 filed 25 May 2012 and claiming the priority of German patent application 102011103326.6 itself filed 27 May 2011.

FIELD OF THE INVENTION

The invention relates to an apparatus for applying glue to fibers or similar particles, particularly for the production of wood-product panels, e.g. fiberboard, having a blow-line through which the fibers to be glued are transported, where a plurality of nozzles that open into the blow-line are connected to the blow-line and spray the fibers transported along the blow line with glue, the nozzles being configured as a multi-substance nozzles, e.g. two-substance nozzles for steam atomization, to which at least one glue-supply line and one steam-supply line are connected.

BACKGROUND OF THE INVENTION

Within the scope of the invention, wood panels particularly means fiberboard such as MDF or HDF or also LDF, for example. Basically, however, plywood and consequently applying glue to chips and similar particles are also covered. Glue application means spraying the fibers with a glue or binder such as, for example, isocyanate, melamine resin formaldehyde (resins), urea formaldehyde (resins), urea formaldehyde (resins), melamine resins, phenolic resins or other resins, for example on the basis of polyamines or tannins. During production of wood-product panels, e.g. fiberboard, a mat of bulk material is formed from the glued fibers, the mat is then compressed in a press with application of pressure and heat to produce a wood-product panel or a wood-product panel web. The press can be a cycled press or a continuously operating press. Applying glue to the fibers has particular importance within the scope of the production of such wood-product panels. This is because the properties of the wood-product panels produced, e.g. their transverse tensile strength, are decisively dependent on the amount of glue used. In order to produce wood-product panels having sufficient transverse tensile strength, significant glue consumption is therefore generally required.

Within the scope of the invention, glue application takes place in a blow-conduit, also called a blow-line. In this technique, the fibers are generally produced from comminuted chips, in a defibrator (refiner), and the fibers are blown out of the refiner into the blow-line. A relatively high steam pressure is present in the refiner. This steam simultaneously forms a transport means that conveys the fibers along the blow line. By the blow-line, the fibers reach a downstream dryer. During blow-glue application, spraying of the fibers with glue takes place in the blow-line, and consequently (directly) downstream of the refiner.

An apparatus for blow-glue application is known, for example, from DE 10 2008 059 877 or DE 10 2009 006 704.

It is basically known that injection of the glue into the blow-line by nozzles has a significant influence on the glue-application quality. Therefore, in practice, one basically strives to achieve the finest possible atomization of the glue in order to form relatively small glue droplets. In this way, clumping of the fibers is supposed to be prevented, and, in particular, a glue is used sparingly. For this reason, it has already been proposed not to atomize the glue by simple compressed air, but rather by using steam. For this purpose, two-substance nozzles are used. Such two-substance nozzles are known, for example, from DE 20 2010 005 280.

Blow-line glue application has basically proven itself. However, it is capable of further development. This is a method that has been well tested for a long time, but the amount of glue used continues to be relatively high. This is where the invention takes its start.

OBJECT OF THE INVENTION

The object of the invention is to create an apparatus with which glue can be applied to fibers or similar particles at high quality and efficiently so that the glued fibers allow efficient production of wood-product panels of high quality.

SUMMARY OF THE INVENTION

To attain this object, the invention teaches, in the case of an apparatus of the described type for applying glue to fibers or similar particles, particularly for the production of wood-product panels, that at least one glue valve and one respective flowmeter are integrated into each of the glue-supply lines, and that the glue valves and the flowmeters are connected with at least one controller working with or without feedback so that the through-flow amount for each glue-supply line can be separately controlled by the glue valves.

In this connection, the invention proceeds from the basically known recognition that relatively small glue droplets can be produced using a multisubstance nozzles, e.g. two-substance nozzles, by steam atomization, which droplets are practical for efficient glue application. The invention now allows sensitive adjustment of the spray parameters and sensitive adjustment of the glue droplet size, so that the optimal operating point of the nozzle is set by corresponding control of the through-flow amounts of the individual valves. In this connection, the invention furthermore proceeds from the recognition that the minimal droplet size does not necessarily lead to the best results, but rather that there is basically an "optimal" droplet size that can depend on the most varied properties and parameters. Within the scope of the invention, sensitive adjustment of the glue-application parameters is now possible to achieve optimal results. For this purpose, it is also possible to act on the glue-application process dynamically and to react to the other process parameters.

Thus, it lies within the scope of the invention that the glue feed to one or more nozzles can be closed off using the glue valves, and that a desired through-flow amount, e.g. an essentially identical or also different through-flow amount can be set for the other nozzles. In this connection, the invention proceeds from the recognition that the refiner and the blow-line generally do not work constantly, but rather the material is transported along the blow line in different amounts and at different pressures over time. According to the invention, the possibility exists of implementing the total amount of the glue to be used per time unit by "closing" one or more nozzles. In this connection, optimal control of the other nozzles is possible at the same time, because the optimal conditions can then be set for the other nozzles, using their flowmeters and the glue valves, so that it is always possible—independent of the number of active nozzles—that the other nozzles work at a predetermined through-flow amount. Thus, in practice all the (active) nozzles are operated at essentially the same through-flow amount. Likewise, however, it can also be practical to set a different glue distribution by the nozzles. Thus, the sprayed amount can increase or decrease along the transport path of the fibers, for example. The ability to control the individual nozzles allows variable adaptation to the conditions and dynamic optimization of the process.

In this connection, preferably at least six, more preferably at least ten nozzles are connected to the blow-line, the nozzles being distributed along the blow-line and/or over around the blow-line. Basically, it can be practical, within the scope of the invention, to work with very many nozzles, because the number of active nozzles can be freely selected, and because it is guaranteed, in particular, that an identical spray amount can be set for all the nozzles.

The glue-supply lines are preferably connected to a common glue manifold to which glue is supplied and that is preferably provided with at least one temperature sensor, one pressure sensor and/or a viscosimeter.

Steam valves can also be integrated into the steam-supply lines. In this connection, however, it is not necessary that these individual steam-supply lines—like the glue-supply lines—are provided with respective flow-control valves, but rather, in connection with the steam supply, it is generally sufficient to use simple shutoff steam valves that either open or close the steam-supply line. Nevertheless, it is practical on the "steam side," as well, to act on the glue-application process by suitable control with or without feedback. For this purpose, the steam-supply lines are connected to a common steam manifold to which steam is supplied, where the steam feed to the steam manifold can be controlled, e.g. the volume flow or the pressure can be controlled. For this purpose, the steam manifold is preferably connected with a temperature sensor, a pressure sensor and/or a flowmeter. While it is practical in the case of the glue-supply lines to assign a separate flowmeter to each individual glue-supply line, it is sufficient in connection with the steam feed within the scope of the invention to place only one flowmeter upstream of the steam manifold. Nevertheless, it is possible to control the steam amount and/or the pressure—as a function of the number of active valves—such that glue atomization can be optimized.

According to a further proposal of the invention, which has particular importance, the controller of the glue applicator is integrated into a master computer that controls the system for production of wood-product panels into which the glue applicator is integrated. The sensors and/or valves, e.g. glue valves, steam valves or the like, are consequently particularly preferably connected with the master process computer that controls the total process in the sense of an overriding lead technology. This master process computer consequently detects not just the operating parameters of the glue applicator, but rather also the other parameters of the pressing system, particularly the parameters of the bulk material spreading system for spreading out the mat of material to be compressed, and the parameters of the press with which the mats of material to be compressed are pressed to form wood-product panels, for example fiberboard, with the application of pressure and heat.

Experiments have shown that it is possible to clearly minimize the amount of solid resin used, at a predetermined transverse tensile strength of the panel to be produced that is to be achieved, using the apparatus according to the invention. The invention makes it possible to adapt the parameters of the glue applicator sensitively as a function of the other process parameters, and to achieve optimal glue-application results in this way. The efficiency of fiberboard production is thereby increased significantly.

In a further preferred embodiment, the invention proposes that lines that supply water to the nozzles for the purpose of cleaning or flushing are connected to the glue-supply lines, for example by multiport valves. In this connection, the invention proceeds from the recognition that it is practical to vary the number of nozzles to be used as a function of the process parameters. In order to prevent an inactive nozzle from becoming clogged with glue, the described water supply is provided. As soon as the control closes off glue application from a nozzle by closing the respective glue valve, water is automatically fed by the respective water-supply line, because the water-supply lines preferably open into the glue-supply lines downstream of the respective control valves, thereby making it possible to meter the water using the same flowmeters that are integrated into the glue-supply lines. Consequently, the water runs through the glue-supply line and the nozzle for a predetermined period of time. Control takes place automatically, preferably also by the master process computer.

A method of applying glue to fibers or similar particles using the above-described apparatus is also an object of the invention. This method is characterized in that the through-flow amount of the glue to the individual nozzles is individually controlled using glue valves of the nozzles. For this purpose, the glue feed to one or more nozzles can be interrupted using the respective glue valves, while the amount fed to the other nozzles is controlled using the glue valves. In this connection, the glue valves, steam valves, water valves, etc. are preferably controlled by a master process computer. The glue applicator and its components are consequently controlled by the master process computer that also controls the blow-line and a downstream spreader and a downstream press. In this connection, the invention proposes that the number of active nozzles/glue-supply lines, the through-flow amount of the glue in the individual lines and/or the through-flow amount of the steam (in total) is/are controlled with or without feedback as a function of the operation of the blow-line, for example as a function of the fiber throughput and/or pressure in the blow-line.

Furthermore, it can be practical to control the through-flow amount of the glue as a function of the viscosity of the glue. For this purpose, it is practical to provide a viscosimeter, for example in the region of the glue manifold. Because the glue can be composed of different components having different viscosities, within the scope of the system, the viscosity of the glue is controlled as a function of the other process parameters, so that dynamic adaptation of the glue properties is possible. In this connection, it can furthermore be practical to set or control the glue pressure as a function of the other parameters. For this purpose, a pressure sensor is provided, for example at the glue manifold. Alternatively or in addition, the possibility exists of also controlling the steam amount as a function of the viscosity.

Within the scope of the invention, usual two-substance nozzles or also a multisubstance nozzles can be used, for example nozzles as described in DE 20 2010 005 280.

BRIEF DESCRIPTION OF THE DRAWING

In the following, the invention will be explained in greater detail with reference to a drawing that shows an embodiment merely as an example. In the drawing.

SPECIFIC DESCRIPTION OF THE INVENTION

Figure 1A:
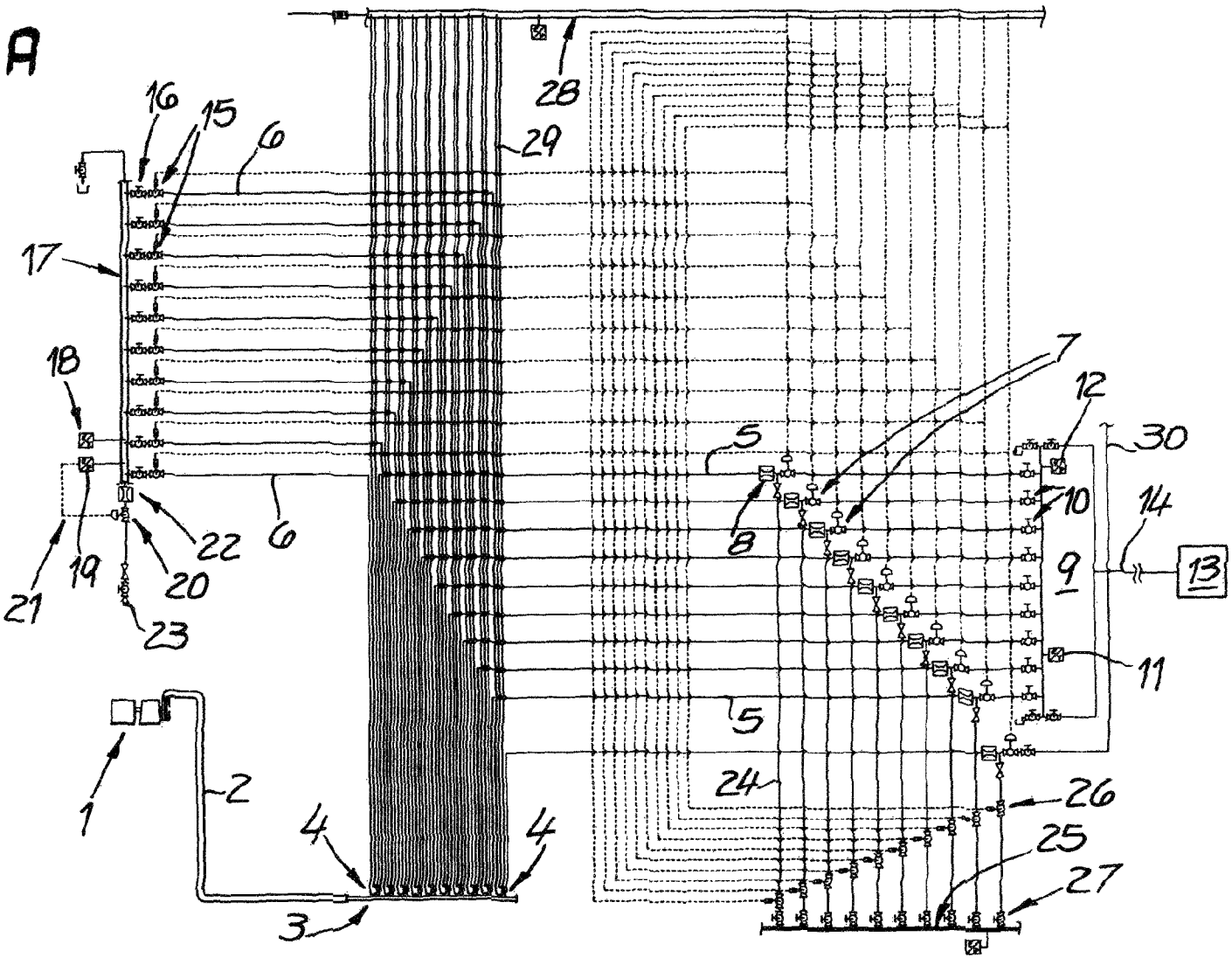
FIG. 1A is a schematic diagram of a glue applicator.

The figures show an apparatus for applying glue to fibers or similar particles for the production of wood-product panels, e.g. fiberboard. Such a glue applicator is consequently integrated into a system for the production of wood-product panels.

The fibers are produced as known per se in a defibrator or refiner 1, for example from comminuted chips. From the refiner 1, the fibers are blown via a fiber-supply line into a blow-line 3, also called a blow conduit, at the high steam pressure that prevails in the refiner. This blow-line has a relatively small diameter of 50 mm to 200 mm, for example, preferably 80 mm to 120 mm. The blow-line 3 can be provided with one or more pressure sensors, not shown, on the inlet side and the outlet side. A plurality of nozzles 4 attached to the blow-line 3 spray the fibers transported along the blow line with glue. In the illustrated embodiment, these nozzles are configured as two-substance nozzles for steam atomization. For this purpose, a glue-supply line 5 and a steam-supply line 6 are connected to each nozzle 4. In the illustrated embodiment, ten nozzles 4 are provided (see FIG. 1A). For reasons of clarity, FIG. 1B shows only one nozzle.

Glue valves 7, on the one hand, and flowmeters 8, on the other hand, are provided in the glue-supply lines 5, specifically, one glue valve 7 and one flowmeter 8 in each glue-supply line 5. The glue-supply lines 5 are then, in turn, connected to a common glue manifold 9 through the respective glue valves 7. The glue valves 7 can be individually controlled, taking the through-flow measurements into consideration, so that the through-flow amount for each glue-supply line 7 can be controlled separately, using the respective glue valve 7. In addition to the glue valves 7, respective shutoff valves 10 that are used when components are replaced, for example, are integrated into each glue-supply line 5. In the illustrated embodiment, the glue manifold 9 is provided with a temperature sensor 11 and a pressure sensor 12, as well as a viscosimeter 32 (FIG. 1B), if applicable. The glue reaches the glue manifold 9 from the schematically shown glue-processing unit 13 through a glue supply 14.

Steam valves 15 are integrated into the steam-supply lines 6, specifically preferably one steam valve 15 in each steam-supply line 6. The individual steam-supply lines 15 can be automatically opened or closed using the respective steam valves 15. Individual control is not provided here. In addition, shutoff valves 16 are provided for maintenance purposes here as well.

The steam-supply lines 6 are connected to a common steam manifold 17. This steam manifold 17 is connected with a temperature sensor 18 and/or a pressure sensor 19. One or more of these sensors, together with a steam supply valve 20 upstream of the steam manifold 17, can form a control circuit 21 so that the through-flow amount or the pressure can be controlled. For this purpose, a flowmeter 22 is placed upstream of the steam manifold 17. The steam supply is indicated at 23.

Furthermore, FIG. 1B shows that a water-supply line 24 opens into the respective individual glue-supply lines 5, these water-supply lines 24 being connected to a common water manifold 25. Respective controllable flow valves 26 as well as shutoff valves 27, too, are integrated into the water-supply lines 24.

Figure 1B:
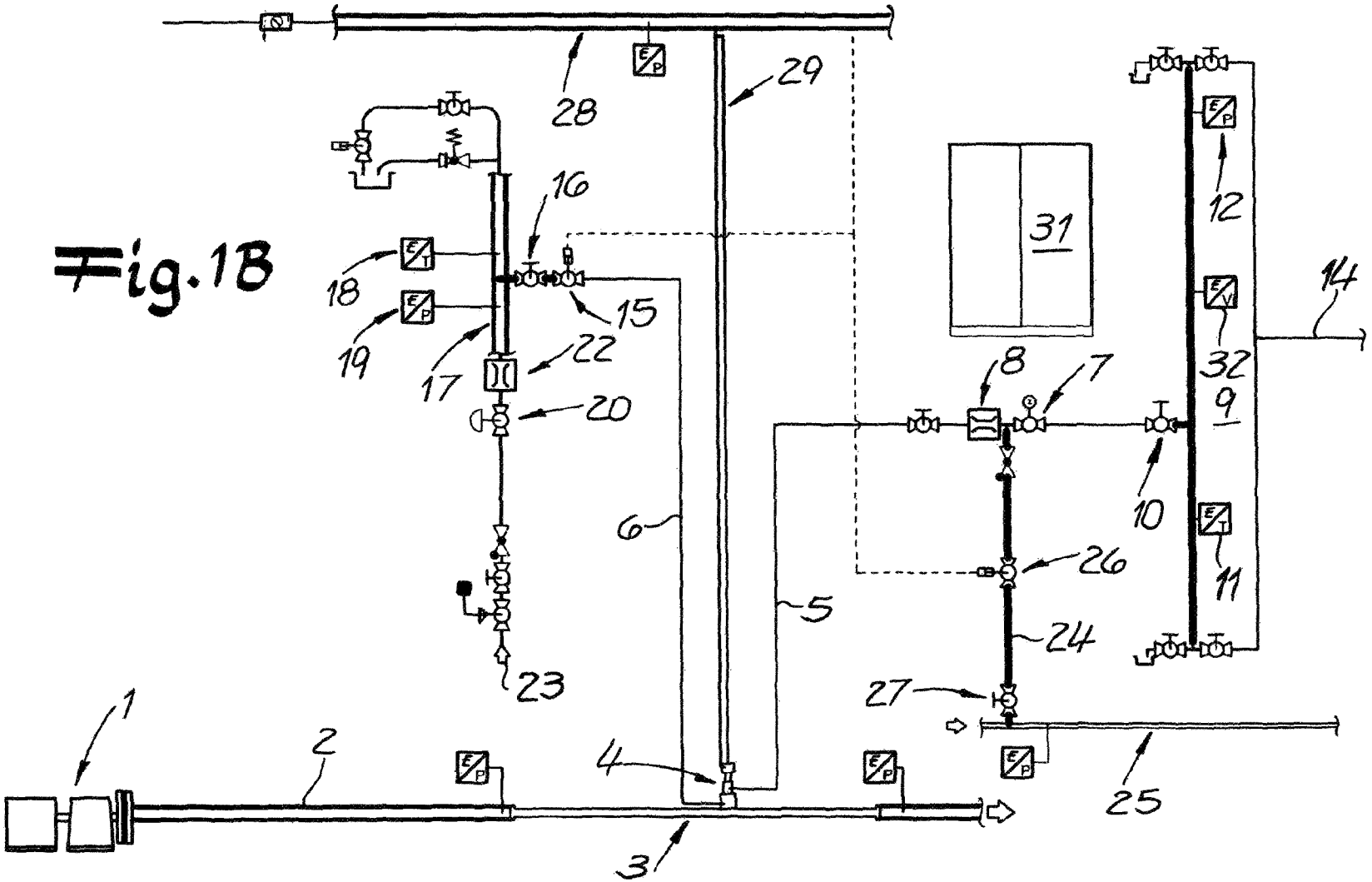
FIG. 1B is a detail view of only one nozzle of the apparatus of FIG. 1A.
Figure 2:
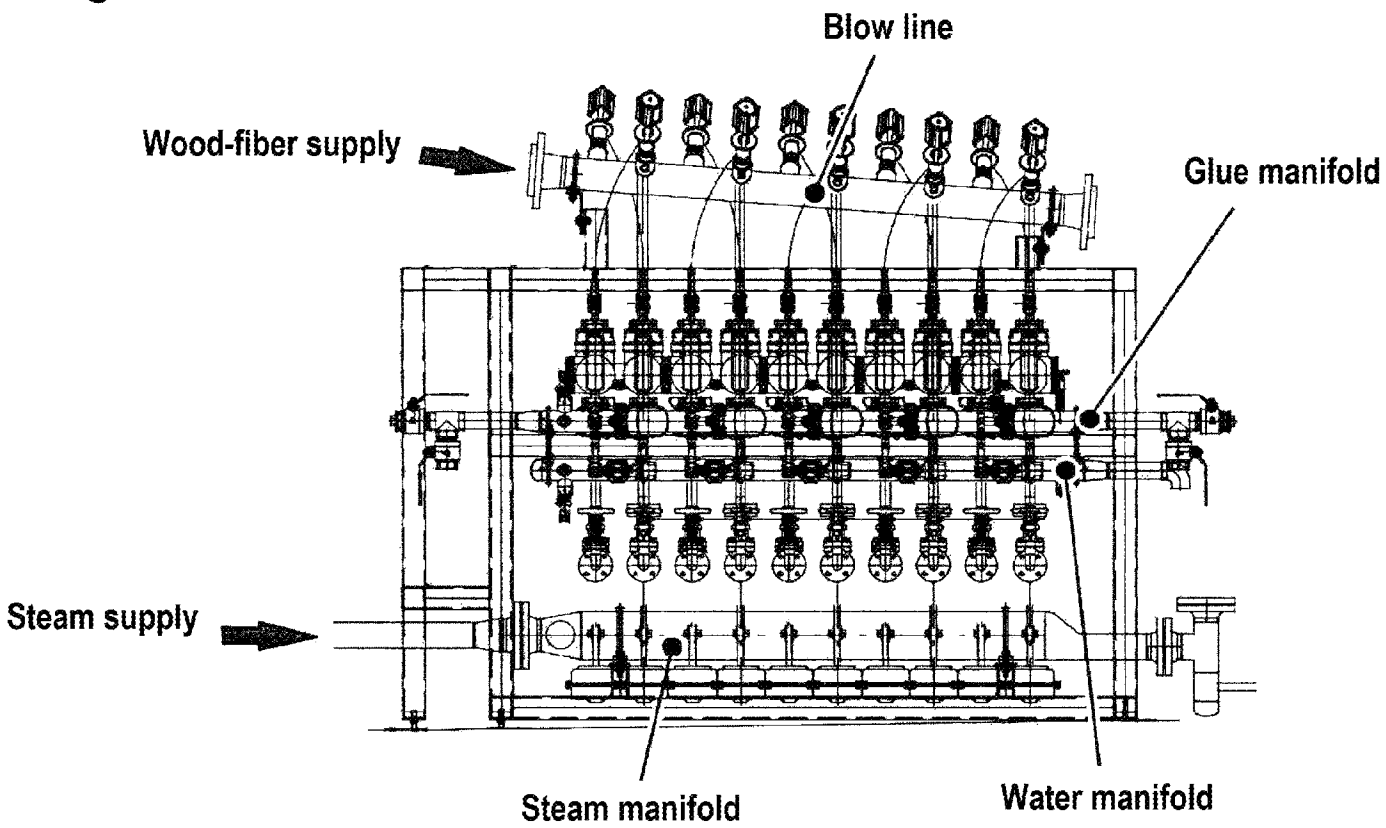
FIG. 2 is a detail side view of a glue applicator.
Figure 3:
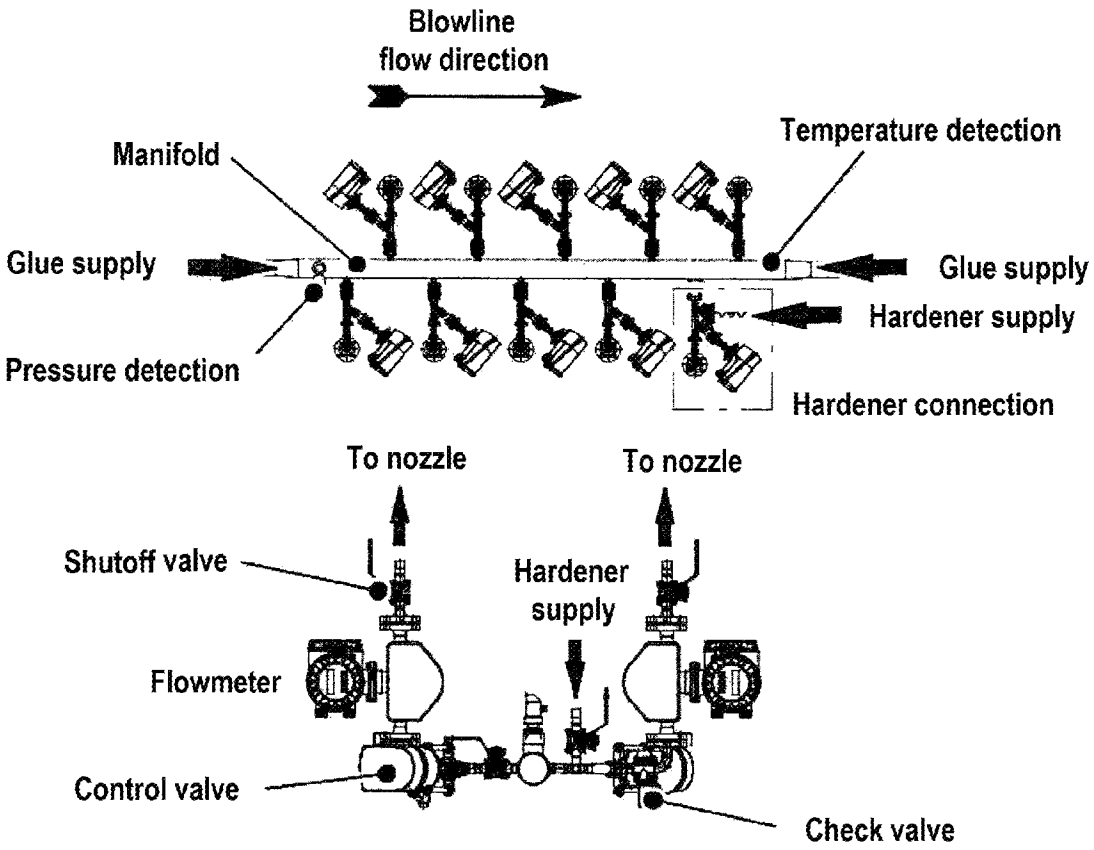
FIG. 3 is two detail views of the structure of FIG. 2.
Figure 4:
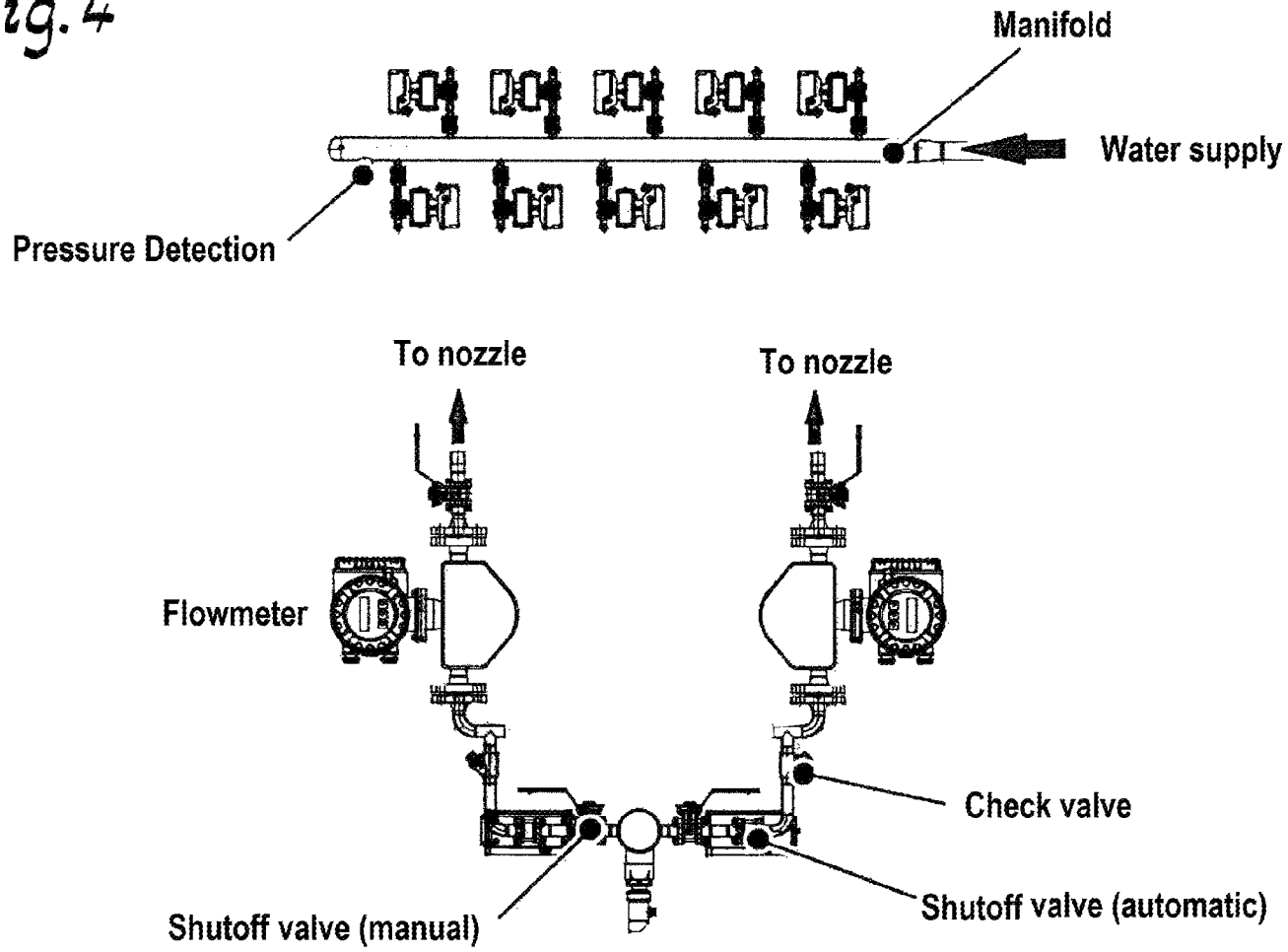
FIG. 4 is two detail views of the structure of FIG. 2.

The components indicated schematically in FIGS. 1A and 1B are found again, in part, in FIGS. 2, 3, and 4.

FIG. 2 particularly shows the blow conduit or blow-line with the feed of the wood fibers indicated. Furthermore, the nozzles connected to the blow-line can be seen there, ten nozzles in the illustrated embodiment that are arrayed in the blow-line one downstream of the other, essentially in a V shape. Glue manifolds, steam manifolds, and water manifolds can also be seen in FIG. 1 [2].

FIG. 3 shows the glue distribution, in particular, in two different views.

FIG. 4 shows the water distribution, in particular, in two different views.

The glue applicator shown is integrated into a master process computer 31. This means that control with or without feedback of the glue applicator takes place with a master process computer that also controls the other components of the fiber panel system, for example the blow-line, the spreader and the press. This computer 31 is indicated schematically in FIG. 1B.

Thus, the glue-application process can be dynamically adapted to the other process parameters. Thus, glue application can be sensitively adapted to the operation of the refiner or of the blow-line. The possibility exists, for example, of deactivating individual glue-supply lines and therefore also glue nozzles, in order to vary the glue application amount in total, so that spraying then takes place only with some of the nozzles. An essentially identical through-flow amount or also a different through-flow amount distribution, for example, can be set for the other active nozzles, by the flowmeters and control valves 7 of the glue applicator. The glue-application process can consequently be influenced, at first, by a sensitive adjustment of the through-flow amount per nozzle by the control valves 7. Furthermore, the possibility exists of influencing the glue-application process dynamically, by adjusting the viscosity of the glue. The glue pressure can also be changed and can, in particular, be evaluated. In this connection, the pressure differential at the blow-line is generally critical. Finally, sensitive adjustment can also take place by steam control with or without feedback. Here, it is sufficient if the individual steam-supply lines 6 are opened or closed by the steam valves 15, as a function of the number of active glue nozzles. Individual control of the steam-supply lines 6 is not required. However, control of the steam feed as a whole by the control circuit 21 shown is practical.

Glue application can be significantly optimized by control of the glue-application system and, in particular, integration of the control into the master process computer 31, so that fiberboard having the required transverse tensile strength can be produced in such a system with clearly reduced glue consumption.

The system is furthermore maintenance-friendly, for example by the possibility of water flushing that is provided. Water flushing automatically starts for individual nozzles 4 during pauses in operation of individual nozzles. This, too, is ensured by the controller, for example the master controller. In this manner, the possibility exists of conducting the glue application variably with a different number of nozzles, without the danger that the nozzles that are deactivated in the meantime become clogged with glue.

In the figures, the compressed air supply for the nozzles or valves is furthermore shown. For this purpose, a compressed air manifold is provided that acts on the nozzle needles of the nozzles, not shown, by compressed air lines 29, in order to open and close them. Furthermore, the individual valve controllers can also be connected to the compressed air manifold 28.

Furthermore, another-supply line 30 for a hardener is indicated in FIG. 1A.

In total, within the scope of the invention, the wood fibers are blown through the blow-pipe 3 and sprayed with active substances, for example glue, by steam-supported nozzles 4.

The nozzles 4 are fed glue or water, depending on the process conditions. Feed of glue or water is controlled by valves. The water is used to flush the nozzles. Water, steam, and glue are supplied to the nozzles by manifolds. The hardener is supplied to the last nozzle of the blow-pipe, directly by the hardener-supply line 30.

In FIG. 3, it is indicated once again that the glue is supplied to the individual nozzles by the manifold pipe. The hardener is supplied to the last nozzle by a separate connector. The connector is attached to the manifold pipe of the glue manifold. The valves control the flow as has been explained. The flowmeter reports the conveyed amount to the controller. The check valve indicated prevents return flow. Shutoff valves serve for replacement of components.

Similarly, further details can be found in FIG. 4 that particularly relates to the water manifold. The water serves for flushing and is supplied to the individual nozzles by the manifold pipe. During interruptions in production, all the nozzles are automatically flushed. During production, only valves that are closed off are flushed. Here, too, valves control the flow. The through-flowmeter reports the conveyed amount to the controller. The check valve prevents return flow here, too. Shutoff valves serve for replacement of components.

The invention claimed is:

1. An apparatus for applying glue to fibers or similar particles for the production of wood-product panels, the apparatus comprising:

a blow-line along which the fibers to be glued are transported in a pressurized-gas stream;

a plurality of nozzles that are distributed along, open into and are connected to the blow-line and that spray the fibers transported along the blow-line with glue, the nozzles being configured as multisubstance nozzles for steam atomization by connection to a respective glue-supply line and a respective steam-supply line;

a respective glue valve and a respective flowmeter integrated into each of the glue-supply lines; and at least one controller connected to the glue valves and the flowmeters so that the through-flow amount for each glue-supply line can be separately controlled by the respective glue valve such that the sprayed amount can increase or decrease along the transport path of the fibers.

2. The apparatus according to claim 1, wherein the glue valves can close off glue feed to the respective nozzles, and a predetermined through-flow amount can be set by the respective glue valves for the other nozzles.

3. The apparatus according to claim 1 wherein at least six of the nozzles are connected to the blow-line and are distributed around the blow-line.

4. The apparatus according to claim 1, further comprising:

respective steam valves integrated into the steam-supply lines.

5. The apparatus according to claim 1, wherein the controller of the glue applicator is integrated into a master process computer that controls a system for production of wood-product panels into which the glue applicator is integrated.

6. The apparatus according to claim 5, wherein the sensors or the glue valves, and the steam valves are connected with the master process computer.

7. The apparatus according to claim 1, further comprising:

water-supply lines that feed water to the nozzles for the purpose of cleaning and that are connected to the glue-supply lines by a multiport valve.

8. The apparatus according to claim 1, further comprising:

means for feeding steam at high pressure to the blow line as the pressurized-gas stream to convey the fibers along the blow line past the nozzles.

9. The apparatus according to claim 8, wherein the means for feeding steam is a refiner that reduces wood chips to the fibers.

10. An apparatus for applying glue to fibers or similar particles for the production of wood-product panels, the apparatus comprising:

a blow-line along which the fibers to be glued are transported;

a plurality of nozzles that open into and are connected to the blow-line and that spray the fibers transported along the blow-line with glue, the nozzles being configured as multisubstance nozzles for steam atomization by connection to a respective glue-supply line and a respective steam-supply line;

a respective glue valve and a respective flowmeter integrated into each of the glue-supply lines; and at least one controller connected to the glue valves and the flowmeters so that the through-flow amount for each glue-supply line can be separately controlled by the respective glue valve; and a common glue manifold to which glue is supplied connected to the glue-supply lines and provided with a temperature sensor, a pressure sensor or a viscosimeter.

11. An apparatus for applying glue to fibers or similar particles for the production of wood-product panels, the apparatus comprising:

a blow-line along which the fibers to be glued are transported;

a plurality of nozzles that open into and are connected to the blow-line and that spray the fibers transported along the blow-line with glue, the nozzles being configured as multisubstance nozzles for steam atomization by connection to a respective glue-supply line and a respective steam-supply line;

a respective glue valve and a respective flowmeter integrated into each of the glue-supply lines;

at least one controller connected to the glue valves and the flowmeters so that the through-flow amount for each glue-supply line can be separately controlled by the respective glue valve;

steam valves integrated into the steam-supply lines; and a common steam-supply line to which steam is supplied connected to the steam-supply lines, steam feed to the steam manifold being controlled with respect to the through-flow amount or the pressure, the steam manifold being connected with a temperature sensor or a pressure sensor or a flowmeter.

* * * * *